US008783267B2

(12) United States Patent
Allen

(10) Patent No.: US 8,783,267 B2
(45) Date of Patent: Jul. 22, 2014

(54) HAIR TRIMMING GUIDE

(71) Applicant: David Michael Allen, Warner Robbins, GA (US)

(72) Inventor: David Michael Allen, Warner Robbins, GA (US)

( * ) Notice: Subject to any disclaimer, the term of this patent is extended or adjusted under 35 U.S.C. 154(b) by 0 days.

(21) Appl. No.: 13/744,679

(22) Filed: Jan. 18, 2013

(65) Prior Publication Data

US 2013/0213429 A1 Aug. 22, 2013

Related U.S. Application Data

(60) Provisional application No. 61/601,525, filed on Feb. 21, 2012.

(51) Int. Cl.
*A45D 24/36* (2006.01)
*A45D 24/34* (2006.01)
*A45D 27/42* (2006.01)

(52) U.S. Cl.
CPC ..... *A45D 24/36* (2013.01); *A45D 27/42* (2013.01)
USPC ..... 132/214; 132/213

(58) Field of Classification Search
CPC ..... A45D 24/36; A45D 27/36
USPC ..... 132/214, 212, 200, 213, 215, 216, 285, 132/289, 319; 33/562, 566, 512; 434/87, 434/88; 101/114, 127; D28/44, 44.2, 10; 30/27, 30; D10/64, 71
See application file for complete search history.

(56) References Cited

U.S. PATENT DOCUMENTS

| | | | | | |
|---|---|---|---|---|---|
| 1,517,166 | A | * | 11/1924 | Powers | 132/214 |
| 1,567,011 | A | * | 12/1925 | Parziale | 132/214 |
| 1,622,647 | A | * | 3/1927 | Jackson | 132/213 |
| 1,645,468 | A | * | 10/1927 | Wilke | 33/562 |
| 2,550,972 | A | * | 5/1951 | Cohen | 132/214 |
| 2,749,922 | A | * | 6/1956 | Daniel et al. | 132/214 |
| 3,407,823 | A | * | 10/1968 | Selvaggio | 132/214 |
| 3,709,234 | A | * | 1/1973 | Seerahn | 132/214 |
| 3,858,589 | A | * | 1/1975 | Geiger | 132/214 |
| 4,106,515 | A | * | 8/1978 | Miller | 132/214 |
| D251,898 | S | * | 5/1979 | Winston | D10/64 |
| 4,414,991 | A | * | 11/1983 | Marcotte | 132/214 |
| 4,502,232 | A | * | 3/1985 | Broders | 33/527 |
| 5,329,946 | A | * | 7/1994 | Guma | 132/213.1 |
| D384,297 | S | * | 9/1997 | Paynes | D10/71 |
| 5,673,711 | A | * | 10/1997 | Andrews | 132/215 |
| 6,944,963 | B2 | * | 9/2005 | Amaru | 33/492 |
| 7,252,094 | B2 | * | 8/2007 | Maynard | 132/214 |
| 7,409,958 | B1 | * | 8/2008 | Vacker | 132/214 |
| D589,648 | S | * | 3/2009 | Bakus | D28/10 |
| 7,559,331 | B2 | * | 7/2009 | Ward | 132/214 |
| D634,893 | S | * | 3/2011 | Brown et al. | D28/44.2 |

(Continued)

*Primary Examiner* — Vanitha Elgart

(57) ABSTRACT

A hair trimming guide offers four edges; a first curved edge, a second curved edge, a first straight edge, and a second straight edge. These four edges allow a person to easily trim or shape their hair, such as a beard, by following the edges of the hair trimming guide. The curved edges are used when a person wants a curved outline to their beard, such as along the cheeks. If no curved outlines are desired, a user can simply trim with the straight edges. For use with larger or smaller facial areas, the hair trimming guide can be offered in multiple sizes, providing a larger size for larger facial areas and a smaller size for smaller facial areas, especially around the nose and mouth. The hair trimming guide is flat and smooth which enables it to be pressed against a user's face without causing discomfort.

4 Claims, 11 Drawing Sheets

(56) References Cited

U.S. PATENT DOCUMENTS

D662,258 S * 6/2012 Chapman ..... D28/44.2
2007/0261709 A1* 11/2007 Bakus ..... 132/214
2009/0183750 A1* 7/2009 Platt-Gregory ..... 132/216
2009/0223530 A1* 9/2009 Chapman ..... 132/200
2012/0234341 A1* 9/2012 Kingery ..... 132/214

* cited by examiner

HAIR TRIMMING GUIDE

The current application claims a priority to the U.S. Provisional Patent application Ser. No. 61/601,525 filed on Feb. 21, 2012.

FIELD OF THE INVENTION

The present invention relates generally to grooming tools and, more particularly, to a contoured shaped plastic guide used for edging bears, mustaches, goatees, and other facial hair.

BACKGROUND OF THE INVENTION

Facial hair is common in modern societies, and can be maintained in a variety of styles. While some choose to go completely clean-shaven, many others prefer to trim their facial hair. Sometimes this is done to simply create clean edges and to maintain a professional appearance. Other times, this is done to groom a specific style of facial hair such as goatees or sideburns. To maintain facial hair in a desired style, a person generally has the options of going to a professional barber or using personal tools to trim their own beard. While both options are feasible and are employed by many people, there are drawbacks to each.

While a professional barber has the training and equipment necessary to trim and maintain a beard, a person can spend a considerable amount of time travelling to a barber. In addition to the time costs, there are monetary costs involved. Depending on the style of facial hair, a professional may have to edge a beard, mustache, and sideburns. While having a professional shave may be an enjoyable experience, the costs add up over time. As a result, many will have a professional shave rarely, choosing to trim their own facial hair the majority of the time.

While many trim their own facial hair, and some are even quite adept at it, there are disadvantages to trimming one's own beard as opposed to hiring a professional. If a person tries to do such trimming on their own it still requires a commitment of time, although not as much as going to a professional barber. In addition, a person must resort to feel and a mirror to properly trim their facial hair, making the process more difficult. While a person's trimming skills may be honed over time, often times a professional will be better, and trimming one's own beard produces in limited results by comparison.

As can be seen, there is a need for a device to assist a person to trim facial hair on their own. Therefore, it is an object of the present invention to provide a guide to assist people with trimming their own facial hair. It is a further object of the present invention to provide a guide which accommodates different curves of various beard styles. It is a further object of the present invention to provide a guide which is convenient to use.

DETAIL DESCRIPTIONS OF THE INVENTION

Figure 1:
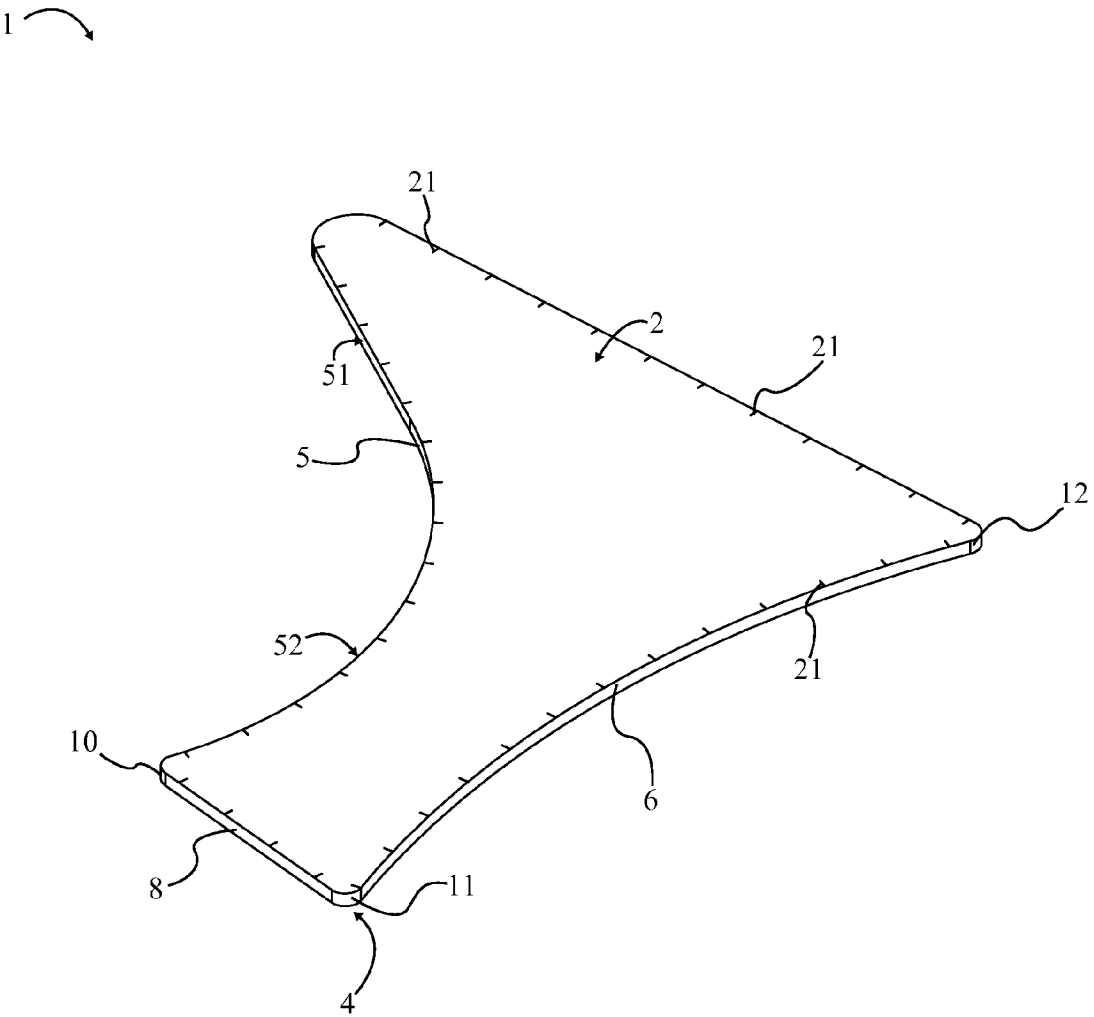
FIG. 1 is a perspective view of the present invention.
Figure 2:
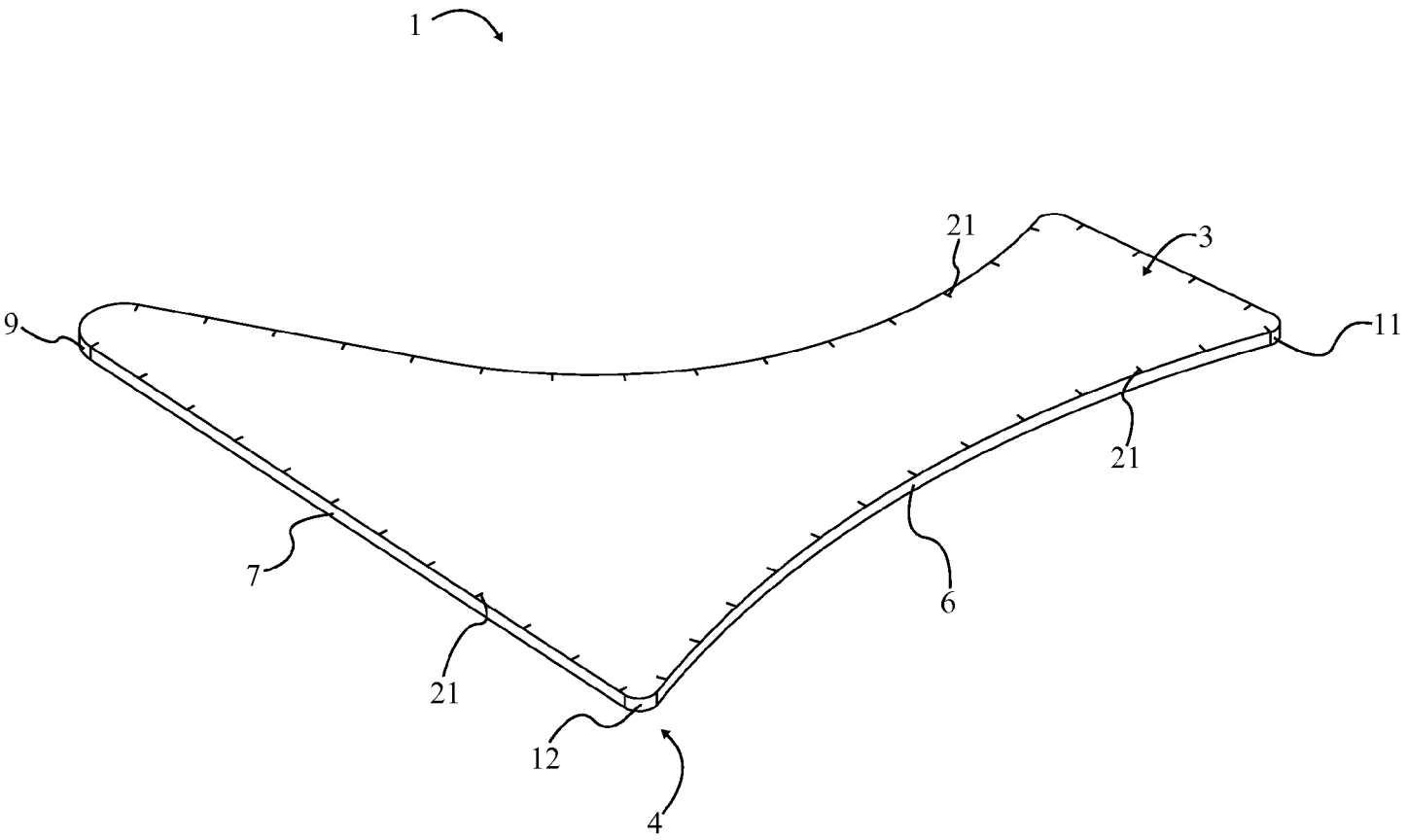
FIG. 2 a bottom perspective view of the present invention.
Figure 3:
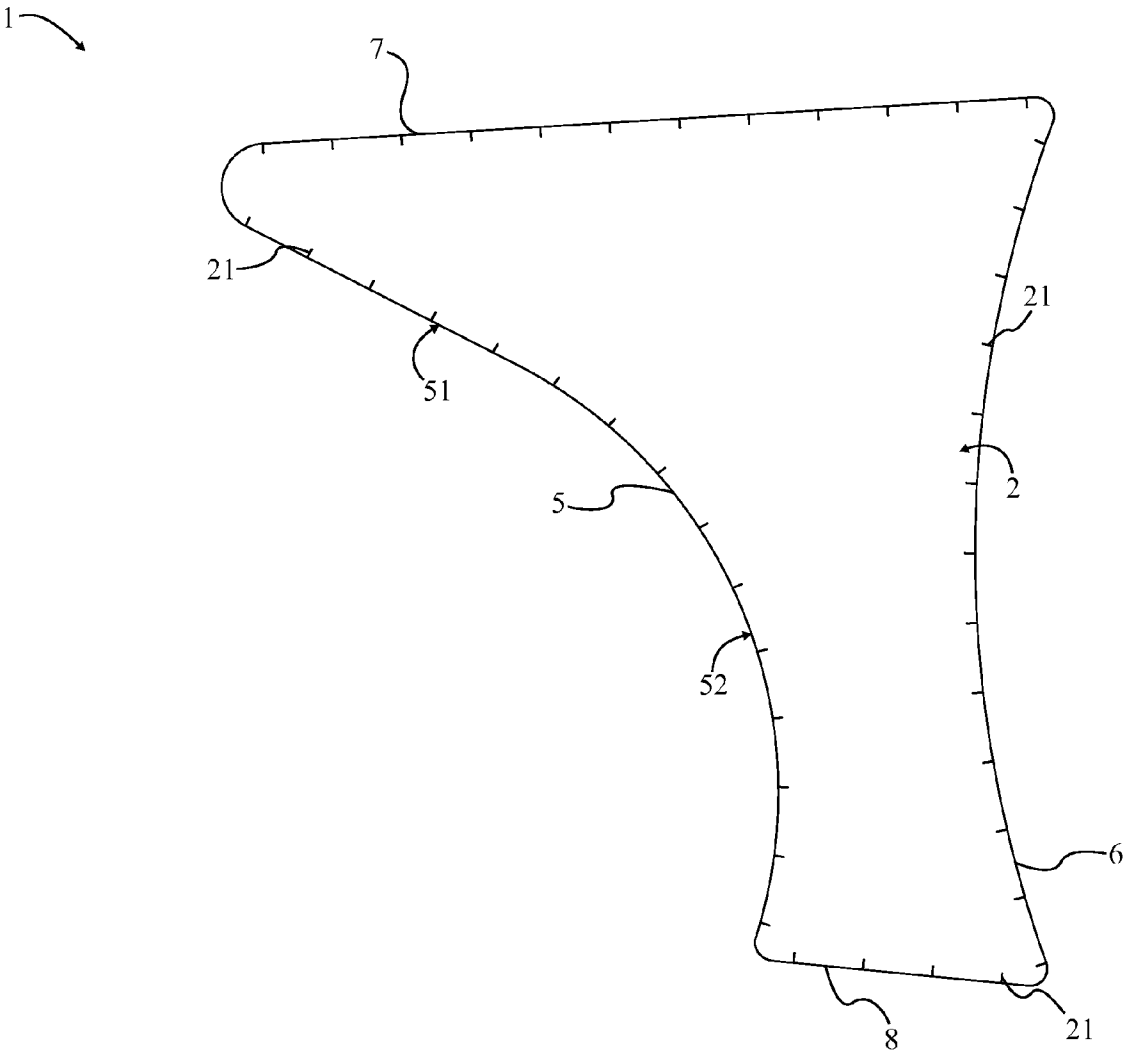
FIG. 3 a top view of the present invention.
Figure 4:
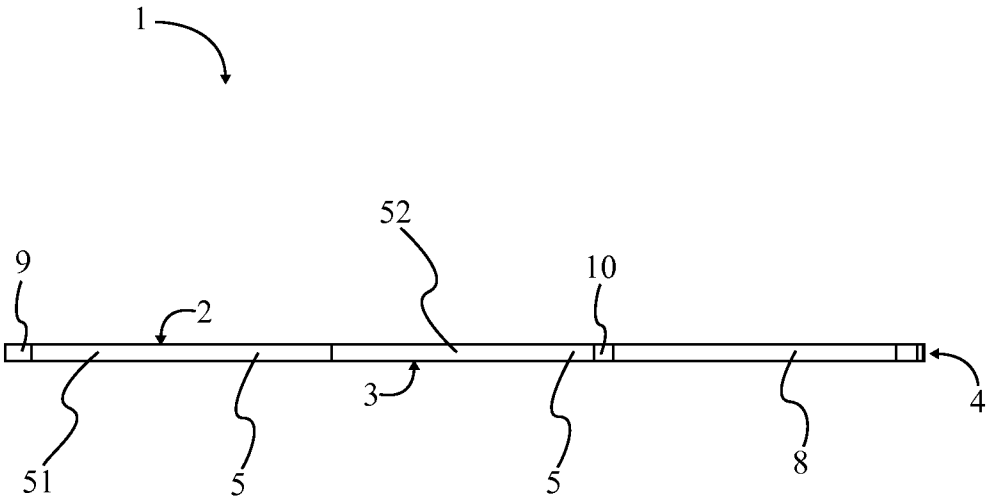
FIG. 4 is a front view of the present invention.
Figure 5:
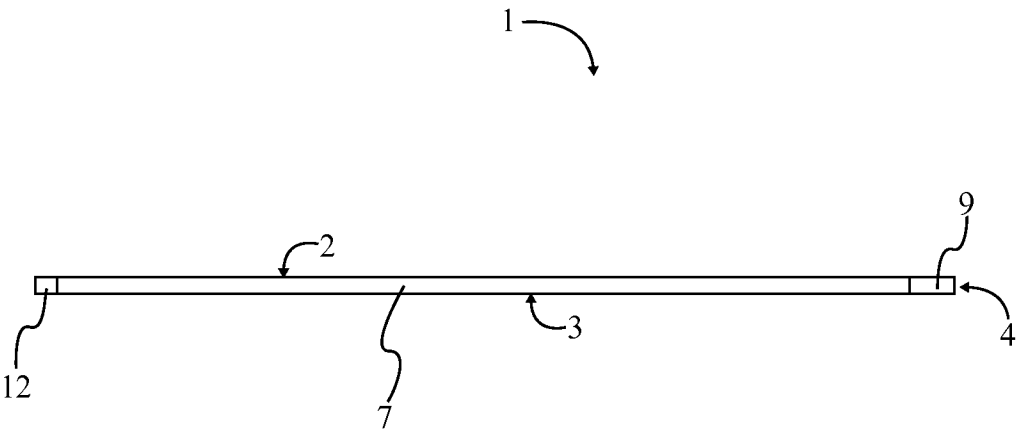
FIG. 5 is a rear view of the present invention.
Figure 6:
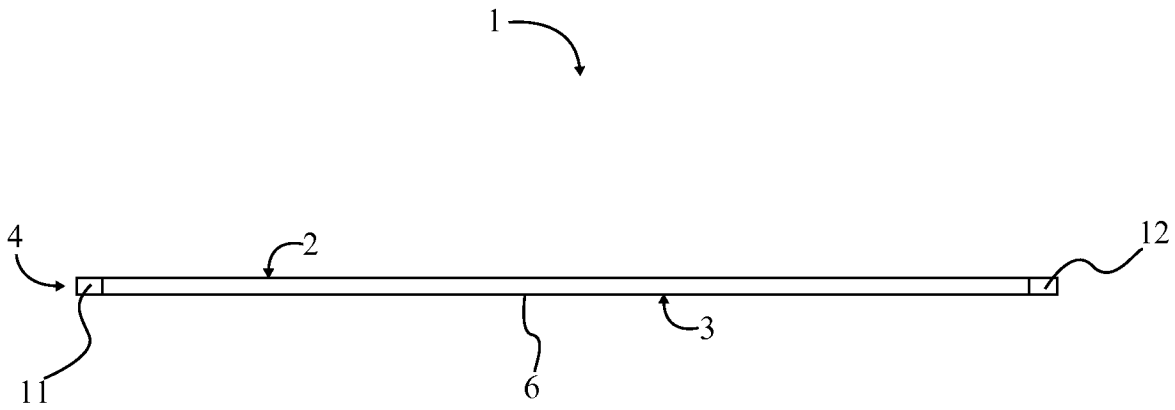
FIG. 6 is a right view of the present invention.
Figure 7:
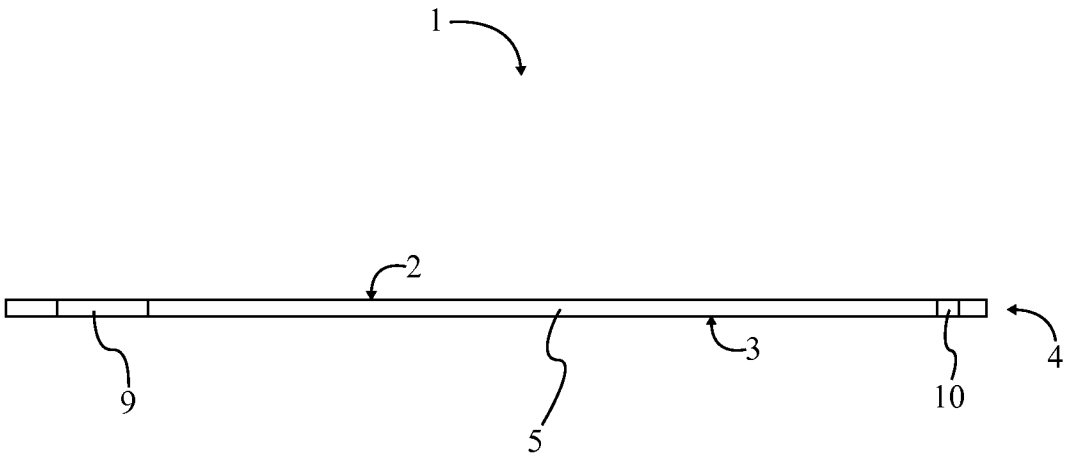
FIG. 7 is a left view of the present invention.
Figure 8:
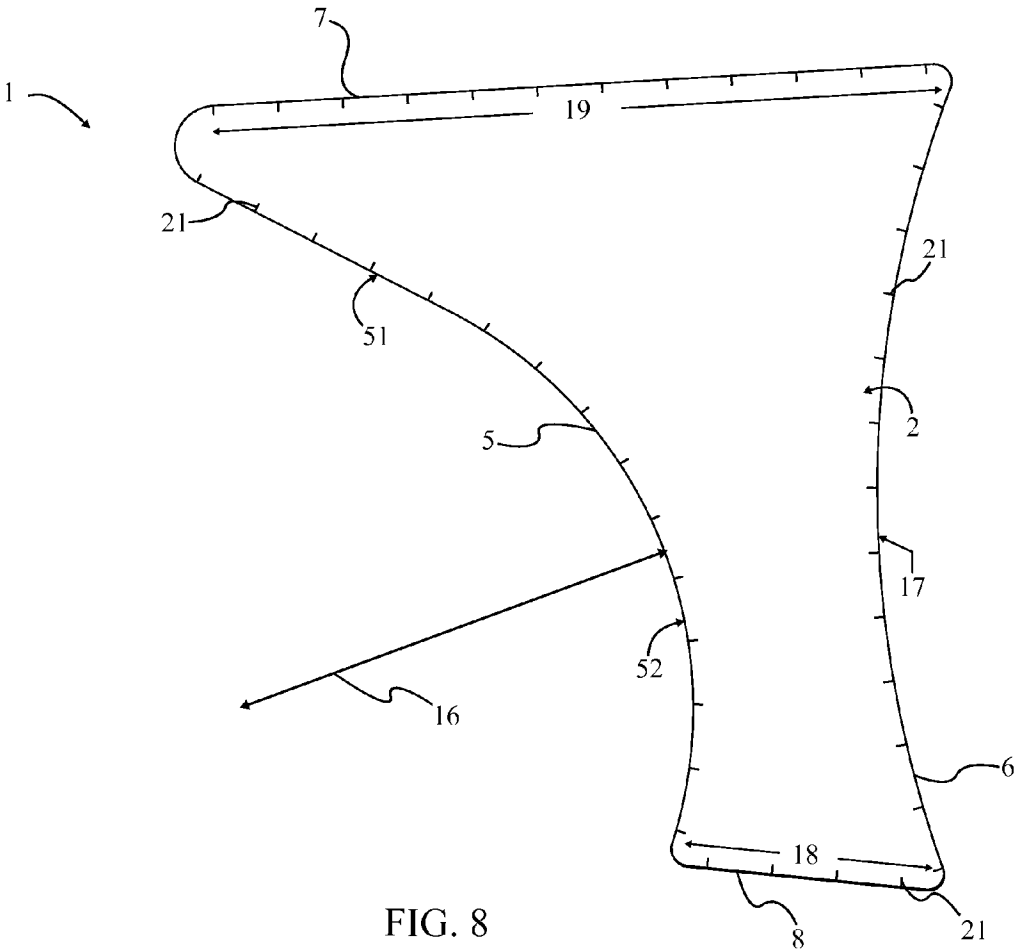
FIG. 8 is an additional top view of the present invention showing the first set of dimensions.
Figure 9:
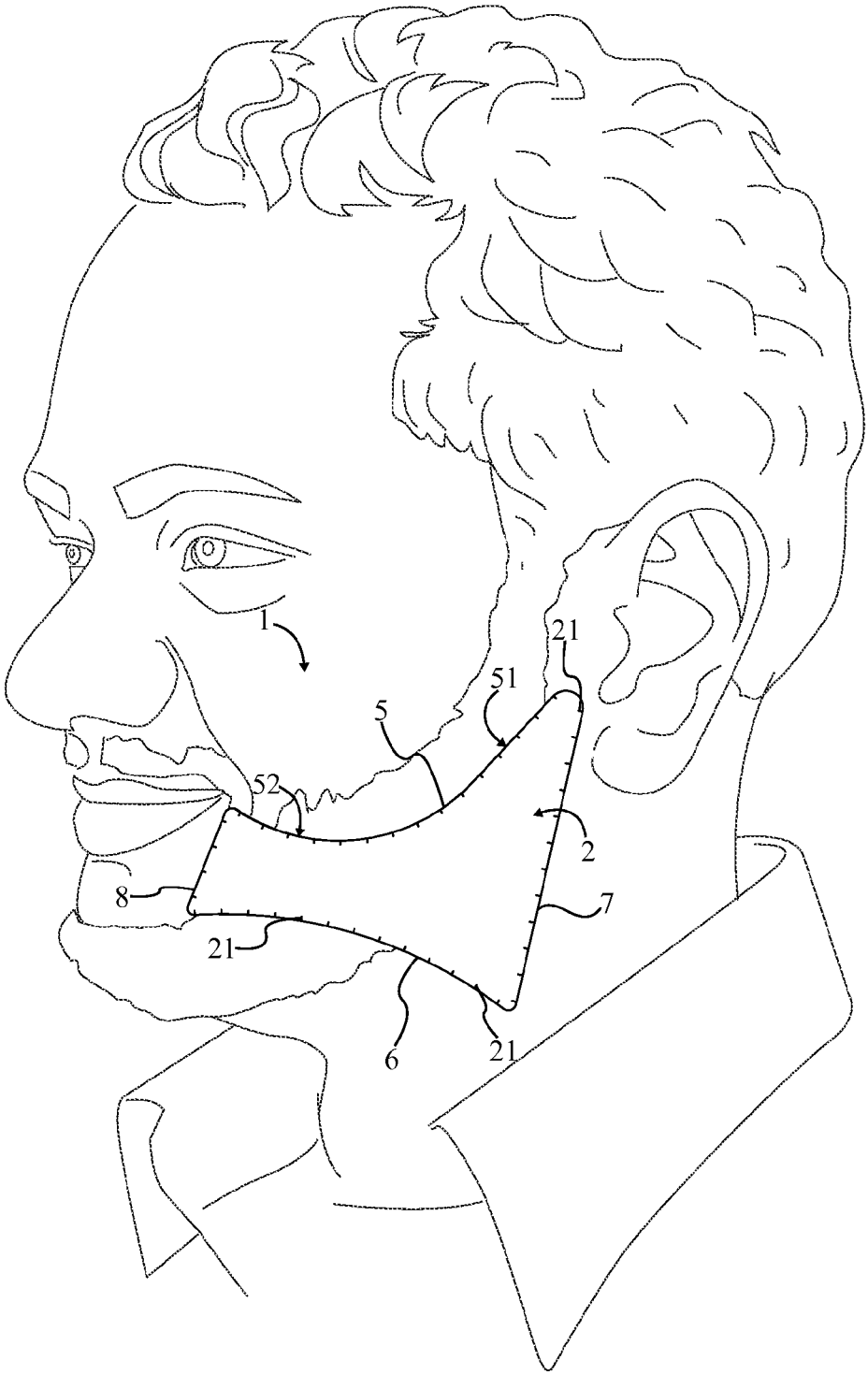
FIG. 9 is a view of the present invention being used to shape a man's beard in the chin area.
Figure 10:
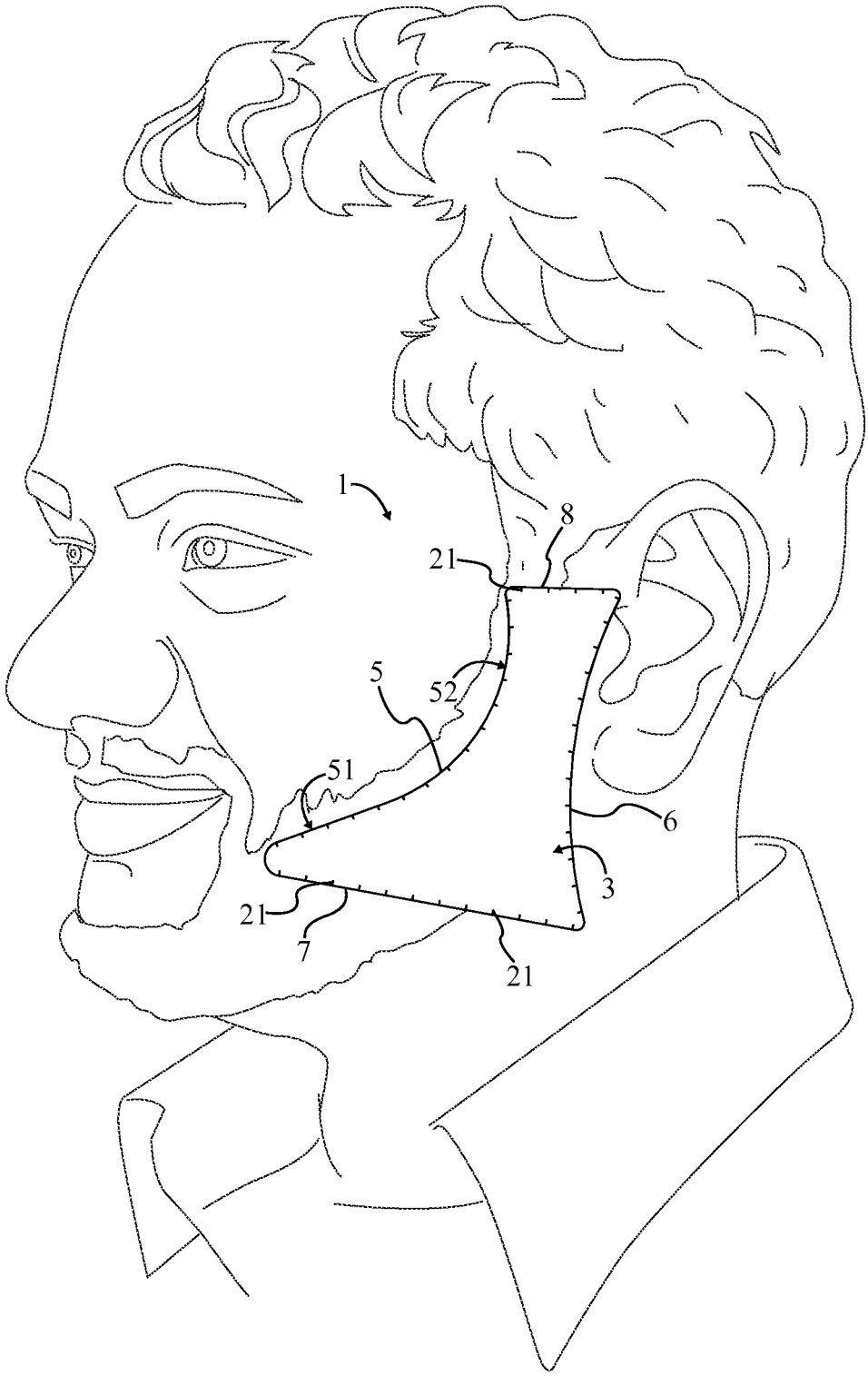
FIG. 10 is a view of the present invention being used to shape a man's beard in the cheek area.
Figure 11:
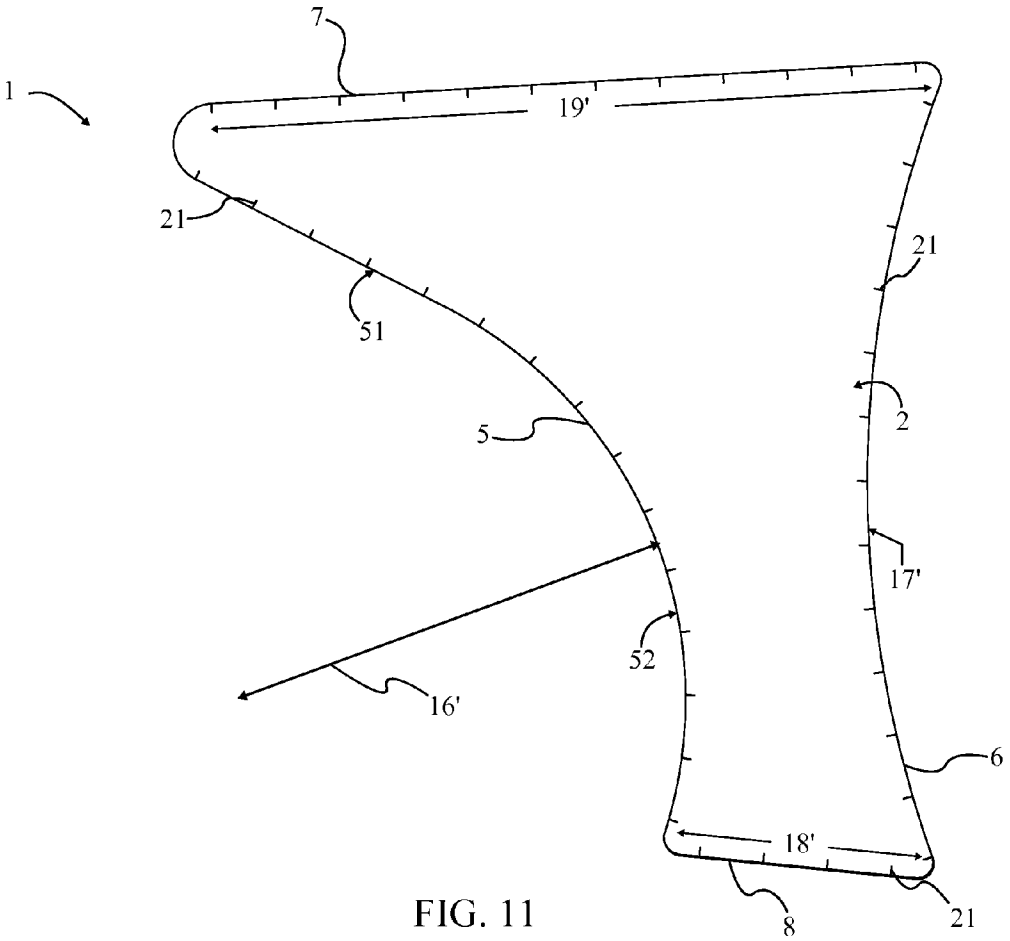
FIG. 11 is an additional top view of the present invention showing the second set of dimensions.

All illustrations of the drawings are for the purpose of describing selected versions of the present invention and are not intended to limit the scope of the present invention.

The present invention is designed to assist a user in trimming and shaping hair. The preferred embodiment is designed to aid in the trimming and shaping of facial hair, although it could also be used to trim and shape hair in other locations, such as on the head and in the pubic regions. The present invention comprises a flat main body 1, which itself comprises a first smooth surface 2, a second smooth surface 3, and a thin lateral surface 4. In combination, the first smooth surface 2 and the second smooth surface 3 form a top and bottom of the present invention, while the thin lateral surface 4 forms a side of the present invention.

The thin lateral surface 4 comprises a first curved edge 5, a second curved edge 6, a first straight edge 7, and a second straight edge 8. Positioned in consecutive order, the first curved edge 5 is followed by first straight edge 7, which is followed by the second curved edge 6, which is followed by the second straight edge 8, which returns to the first curved edge 5. The design results in the curved edges being separated from each other by the straight edges. Similarly, the design is such that the straight edges are separated from each other by the curved edges. As a result, the first curved edge 5 is positioned adjacent to the first straight edge 7 and the second straight edge 8, just as the first straight edge 7 is positioned adjacent to the first curved edge 5 and the second curved edge 6. Similar to the first curved edge 5, the second curved edge 6 is positioned adjacent to the first straight edge 7 and the second straight edge 8, but on an opposite side of the flat main body 1 from the first curved edge 5. The second straight edge 8 has a similar relation to the first straight edge 7, being positioned on an opposite side of the flat main body 1 adjacent to the first curved edge 5 and the second curved edge 6. In the preferred embodiment, the first curved edge 5 comprises a linear segment 51 and a curved segment 52. The linear segment 51 forms a tail end for the curved segment 52. This is useful since the first curved segment would otherwise have such a large curvature that it would prove unwieldy for the average person's face.

In addition to the curved and straight edges, the thin lateral surface 4 comprises a first fillet 9, a second fillet 10, a third fillet 11, and a fourth fillet 12. The first fillet 9 is joins the first curved edge 5 and the first straight edge 7 to each other. The second fillet 10 joins the first curved edge 5 and the second straight edge 8 to each other. The third fillet 11 joins the second curved edge 6 and the second straight edge 8 to each other. Completing the thin lateral surface 4 is the fourth fillet 12, which joins the second curved edge 6 and the first straight edge 7 to each other.

The thin lateral surface 4 provides a guide with which a user can trim and shape their beard. To allow for different beard styles, the present invention provides two curved edges and two straight edges. The first curved edge 5 possesses a greater length and smaller radius of curvature than the second curved edge 6. Likewise, the first straight edge 7 is longer than the second straight edge 8. The first curved edge 5 and the first straight edge 7 are advantageous for shaping and trimming large areas across the face, such as along the cheeks and neck. The large size of the first curved edge 5 and the first straight edge 7 allow a user to trim aforementioned facial areas without having to constantly move and adjust the present invention. If the first curved edge 5 and first straight edge 7 are longer than necessary, a user can resort to the smaller second curved edge 6 and second straight edge 8. These are especially useful when trimming a smaller section of facial hair. For example, when trimming sideburns a user may prefer to use the smaller second straight edge 8, finding that the longer first straight edge 7 results in a larger than preferred sideburn. Though a user could instead use the first straight edge 7 and terminate the sideburn at a point along the first straight edge 7, this would be difficult to mirror on the opposite side of the face. By using the smaller second straight edge 8, a use can achieve sideburns with the exact same length on each side of the face.

Other aspects of the present invention are meant to compliment the primary function of the first curved edge 5, second curved edge 6, first straight edge 7, and second straight edge 8. The flat main body 1 is designed so that a user can comfortably press the present invention against their face, which is necessary when using the edges as a guide for trimming or shaping. Though a non-flat embodiment is possible, any unnecessary ridges or bumps could cause discomfort for a user; as a result, the flat main body 1 is employed by the preferred embodiment.

The thin lateral surface 4 is employed to reduce bulk and enhance usability of the present invention. Since the present invention is pressed against a users face during use, minimizing weight and bulk provides a more user-friendly experience. If, instead of a thin lateral surface 4, there were a thick one, then the increased heft would make the present invention uncomfortable and difficult to hold against a user's face.

The first fillet 9, second fillet 10, third fillet 11, and fourth fillet 12 are included to round out the lateral surface, minimizing sharp surfaces. By using fillets instead of sharp corners, the likelihood of the present invention causing discomfort to a user is further reduced. While sharp corners could poke against or scratch a user's face, fillets present rounded edges which impart less force at any one point by providing a larger area of contact. Similar to the flat main body 1 and thin lateral surface 4, this improves the usability of the present invention by reducing potential causes of user discomfort. In the preferred embodiment, the fillets are tangent curves to the edges of the present invention.

For general usage, there is a first set of dimensions provided for the present invention, including a thickness, a first radius of curvature 16, a second radius of curvature 17, a first length 18, and a second length 19. The first radius of curvature 16 applies to the first curved edge 5 while the second radius of curvature 17 applies to the second curved edge 6. Similarly, the first length 18 applies to the first straight edge 7 and the second length 19 applies to the second straight edge 8. The first set of dimensions provides a thickness of 0.093 inches, a first radius of curvature 16 of 2.76 inches, a second radius of curvature 17 of 7.00 inches, a first length 18 of 4.42 inches, and a second length 19 of 1.06 inches.

For areas of the face with less room or styles that have more difficult contours, the second curved edge 6 and the second straight edge 8 are provided. For example, around the mouth, between the mouth and nose, and adjacent to the ears there is less space to work with. In this instance, a more compact, portable, and maneuverable embodiment is provided to accommodate smaller facial areas. This secondary embodiment employs a second set of dimensions and is intended to be approximately 30% smaller than the preferred embodiment; outside of size, this secondary embodiment shares the same components and relevant relations as the preferred embodiment. The second set of dimensions provides a thickness of 0.093 inches, a first radius of curvature 16' of 2.50 inches, a second radius of curvature 17' of 7.00 inches, a first length 18' of 3.34 inches, and a second length 19' of 0.85 inches. This more compact size makes the secondary embodiment effective for use with smaller facial areas, as stated above.

To aid in exact trimming and shaping, the first smooth surface 2 and the second smooth surface 3 each comprise a plurality of measurement markings 21. These measurement markings 21 allow a person to better measure and duplicate the trimmed areas on either side of the face. For example a person might want to pattern their beard to have a 2 inch straight section and then 5 inch curves section. By providing the plurality of measurement markings 21 a person is able to exactly measure each section, helping to achieve identical results on either side of the face.

To use the present invention a user simply selects one of the edges that provides a desired contour, selecting from the first curved edge 5, second curved edge 6, first straight edge 7, and second straight edge 8. The specific edge selected will depend on the size of the facial area that is being trimmed, and whether the user wants a straight or curved contour for their facial hair. After selected a desired edge, the user places the flat main body 1 on their face such that the flat main body 1 covers a portion of hair that is not intended to be trimmed. The fillets adjacent to the edge are used to provide a reference position for the flat main body 1. For example, when trimming a cheek, a user might select the larger sized first curved edge 5. At either end of the first curved edge 5 is the first fillet 9 and the second fillet 10. In this scenario, the use would place the flat main body 1 such that the first fillet 9 is at the top of the cheek section where the sideburns meet the hair from the head, while the second fillet 10 would be positioned near the base of the nose. This provides a simple curve that can be followed when trimming the cheek area of the face.

Once the flat main body 1 is in position the use can proceed to trim their hair. This is done by placing the edge of a clipper or trimmer against the selected edge (of the flat main body 1) and moving the cutting device along the selected edge until the facial hair adjacent to the flat main body 1 has been trimmed. After trimming one side of the face, a user can simply flip the flat main body 1 and make the same cuts to the opposite side of the face. By using the same reference positions for the curved edges and straight edges, as well as the associated fillets, a user can make the same trim on either side. This results in a trimmed area having the same contour on each side of the face, which may prove difficult for those who trim by eye, including professionals.

The present invention can be constructed from a number of materials, such as an FDA approved acrylic or polypropylene. Potentially, the flat main body 1 will be rigid, to aid with keeping a steady edge when shaping and trimming facial hair. However, in other embodiments the flat main body 1 can be made of a flexible material, such as certain plastics, that allows a user to more comfortably press the flat main body 1 against their face. Since the human face is not flat, a flexible flat main body 1 could adjust to the contours of a person's face and prove more comfortable than a rigid flat main body 1. However, this flexible flat main body 1 essentially sacrifices some usability for comfort, since a flexible flat main body 1 will be more difficult to use a as a guide when compared to a rigid flat main body 1.

Although the invention has been explained in relation to its preferred embodiment, it is to be understood that many other possible modifications and variations can be made without departing from the spirit and scope of the invention as hereinafter claimed.

What is claimed is:

1. A hair trimming guide comprises, a flat main body;

the flat main body comprises a first smooth surface, a second smooth surface, and a thin lateral surface;

the first smooth surface and the second smooth surface being connected parallel to each other by the thin lateral surface;

the thin lateral surface being positioned perpendicular to and in between the first smooth surface and the second smooth surface;

the thin lateral surface comprises a first curved edge, a second curved edge, a first straight edge, and a second straight edge;

the first curved edge being positioned adjacent to the first straight edge;

the second curved edge being positioned adjacent to the first straight edge;

the first curved edge and the second curved edge being positioned oppositely;

the first curved edge being positioned adjacent to the second straight edge;

the second curved edge being positioned adjacent to the second straight edge;

the first curved edge and the second curved edge being positioned opposite each other across the main body;

the first curved edge being longer than the second curved edge;

the first straight edge being longer than the second straight edge;

a first set of dimensions being used for a large facial area, wherein the first set of dimensions includes a thickness for the flat main body, a first radius of curvature for the first curved edge, a second radius of curvature for the second curved edge, a first length for the first straight edge, and a second length for the second straight edge;

the flat main body having the thickness of 0.093 inches;

the first curved edge having the first radius of curvature of 2.76 inches;

the second curved edge having the second radius of curvature of 7.00 inches;

the first straight edge having the first length of 4.42 inches; and the second straight edge having the second length of 1.06 inches.

2. The hair trimming guide as claimed in claim 1 comprises, a second set of dimensions being used for a small facial area, wherein the second set of dimensions includes a thickness for the flat main body, a first radius of curvature for the first curved edge, a second radius of curvature for the second curved edge, a first length for the first straight edge, and a second length for the second straight edge;

the flat main body having the thickness of 0.093 inches;

the first curved edge having the first radius of curvature of 2.50 inches;

the second curved edge having the second radius of curvature of 7.00 inches;

the first straight edge having the first length of 3.34 inches; and the second straight edge having the second length of 0.85 inches.

3. A hair trimming guide comprises, a flat main body;

the flat main body comprises a first smooth surface, a second smooth surface, and a thin lateral surface;

the first smooth surface and the second smooth surface being connected parallel to each other by the thin lateral surface;

the thin lateral surface being positioned perpendicular to and in between the first smooth surface and the second smooth surface;

the thin lateral surface comprises a first curved edge, a second curved edge, a first straight edge, a second straight edge, a first fillet, a second fillet, a third fillet, and a fourth fillet;

the first curved edge comprises a linear segment and a curved segment;

the first curved edge being positioned adjacent to the first straight edge;

the second curved edge being positioned adjacent to the first straight edge;

the first curved edge and the second curved edge being positioned oppositely;

the first curved edge being positioned adjacent to the second straight edge;

the second curved edge being positioned adjacent to the second straight edge;

the first curved edge and the second curved edge being positioned opposite each other across the main body;

the first curved edge being longer than the second curved edge;

the first straight edge being longer than the second straight edge;

a set of dimensions being used for a small facial area, wherein the set of dimensions includes a thickness for the flat main body, a first radius of curvature for the first curved edge, a second radius of curvature for the second curved edge, a first length for the first straight edge, and a second length for the second straight edge;

the flat main body having the thickness of 0.093 inches;

the first curved edge having the first radius of curvature of 2.50 inches;

the second curved edge having the second radius of curvature of 7.00 inches;

the first straight edge having the first length of 3.34 inches; and the second straight edge having the second length of 0.85 inches.

4. The hair trimming guide as claimed in claim 3 comprises, another set of dimensions being used for a large facial area, wherein the another set of dimensions includes a thickness for the flat main body, a first radius of curvature for the first curved edge, a second radius of curvature for the second curved edge, a first length for the first straight edge, and a second length for the second straight edge;

the flat main body having the thickness of 0.093 inches;

the first curved edge having the first radius of curvature of 2.76 inches;

the second curved edge having the second radius of curvature of 7.00 inches;

the first straight edge having the first length of 4.42 inches; and the second straight edge having the second length of 1.06 inches.

* * * * *